US005307996A

United States Patent [19]

Kataoka et al.

[11] Patent Number: 5,307,996

[45] Date of Patent: May 3, 1994

[54] ATOMIZER FOR SLURRY FUEL

[75] Inventors: Shizuo Kataoka, Takatsuki; Osamu Nojiri, Osaka; Haruo Nogami, Amagasaki; Kiyomitsu Ikawa, Itami; Yasuo Shimizu, Nara, all of Japan

[73] Assignee: Takuma Co., Ltd., Osaka, Japan

[21] Appl. No.: 926,222

[22] Filed: Aug. 5, 1992

[51] Int. Cl.[5] ..... F23D 21/00

[52] U.S. Cl. ..... 239/424; 239/433; 239/524

[58] Field of Search ..... 239/423, 424, 433, 524

[56] References Cited

U.S. PATENT DOCUMENTS 1,669,810 5/1928 Clapham ..... 239/433
4,361,285 11/1982 Koppehele et al. ..... 239/424
4,728,036 3/1988 Bennett et al. ..... 239/433

*Primary Examiner*—Karen B. Merritt
*Attorney, Agent, or Firm*—Flynn, Thiel, Boutell & Tanis

[57] ABSTRACT

An atomizer for slurry fuel which provides improved assembly thereof and improves the atomization of fuel and provides improved wear resistance. The atomizer for slurry fuel comprises an intermediate member, a slurry fuel passage and a gas passage respectively integrally formed of ceramic, and a mixing chamber being provided at the upstream side of a fuel jet port for mixing slurry fuel with gas, the intermediate member being fixed to a fuel supply body by a cap together with a steam cap and a fixed ring formed of ceramic, respectively and a set bolt fixing a target formed of ceramic to the intermediate member by penetrating a target support member and being retained to a strut wall by a lock nut.

7 Claims, 2 Drawing Sheets

ATOMIZER FOR SLURRY FUEL

BACKGROUND OF THE INVENTION

1. Field of the Invention

The present invention relates to an atomizer for atomizing and burning a slurry fuel represented by the mixture of coal and water (hereinafter referred to as CWM).

2. Prior Art

A conventional atomizer for slurry fuel is disclosed in Japanese Patent Publication No. 1-41891 wherein an atomizer body is detachably attached to a tip end of a fuel supply body having a first passage serving as a CWM introduction passage and a second passage which is provided outside the first passage and serves as an atomizing gas introduction passage.

In the conventional atomizer for slurry fuel, there are such problems that firstly it is difficult to attach the atomizer body to the fuel supply body since a steam guide is provided separately from an annular intermediate member to which a target is fixed and the CWM is jetted from a ring-shaped fuel jet port forming an annular liquid film being insufficiently mixed with gas. Furthermore, there is another problem that the intermediate member and a steam cap contact the CWM so that they are liable to wear.

SUMMARY OF THE INVENTION

The present invention has been made to solve the problems of the conventional atomizer and has an object to provide an atomizer for slurry fuel having a CWM passage and a gas passage which are integrally provided on the intermediate member and a mixing chamber disposed at the upstream side of a fuel jet port for mixing the CWM and the gas, which is excellent in assembling the atomizer and the atomization of fuel.

It is another object of the present invention to provide the atomizer for slurry fuel which facilitates to atomize the fuel by effectively jetting the CWM forming an annular liquid film against which the gas strikes.

It is still another object of the present invention to provide the atomizer for slurry fuel having a target, an intermediate member and a steam cap which are formed of ceramic for preventing these components from wearing so as to assure durability and reliability thereof.

To achieve the above object, the atomizer for slurry fuel according to the first aspect of the present invention comprises a fuel supply body having a first passage serving as a CWM passage and a second passage disposed outside the first passage serving as a gas passage and an atomizer body detachably attached to the tip end portion of the fuel supply body, characterized in that the atomizer body comprises an annular slit which communicates with the first passage for jetting the CMW so as to form an annular liquid film, a tip portion for retaining a target which defines the inner surface of a fuel jet port, an intermediate member having a plurality of communication ports for communicating with the second passage, a gas jet port which cooperates with outlets of the communication ports and is directed toward the end side of the annular slit, an opening surface which cooperates with the target for forming the outer surface of the fuel jet port, a steam cap having a mixing chamber which is defined between the gas jet port and the fuel jet port and a fixed ring disposed at the rear end of the The atomizer for slurry fuel according to the second aspect of the present invention comprises a projection formed at the tip end of the annular slit of the intermediate member.

The atomizer for slurry fuel according to the third aspect of the present invention includes an atomizer body composed of an intermediate member, a steam cap and a target respectively formed of ceramic and a set bolt for fixing the target to the intermediate member, penetrates the intermediate member and is retained at the rear end thereof by a lock nut whereby the atomizer body is fixed to the fuel supply body by a metal cap.

With the arrangement of the atomizer for slurry fuel set forth above, the CWM is introduced into the annular slit through the fuel introduction passage and is jetted from the annular slit so as to form the annular liquid film against which the annular current atomizing gas strikes whereby the CWM is atomized as it is separated from the surface of the annular liquid film. The CWM is mixed with the gas in the mixing chamber wherein the CWM is atomized more finely. The liquid film of the CWM expands along the tapered target 1 so that the area of the CWM contacting the atomized gas is enlarged, which facilitates the atomization of the CWM. The CWM is jetted from the fuel jet port while it is atomized more finely.

Since the slurry fuel passage and the gas passage are integrally formed on the intermediate member, the atomizer body can be attached to the CWM supply body with ease.

If the projection is formed on the tip end portion of the annular slit of the intermediate member, the CWM is more effectively jetted from the annular slit so as to form the annular liquid film against which the gas strikes whereby the more fine atomization is performed.

Furthermore, since the intermediate member, the steam cap and the target are respectively formed of ceramic, the set bolt for fixing the target to the intermediate member penetrates the intermediate member and is retained at the rear end thereof by the lock nut and the atomizer body is fixed to the CWM supply body by the metal cap, the components are less worn by the CWM. Still furthermore, the target, which is subjected to the high temperature, is not fixed to the intermediate member directly by the screw, the set bolt is prevented from being burned to stick to the target. Still furthermore, the ceramic components are attached to the CWM supply body in the direction of compressing thereof.

PREFERRED EMBODIMENT OF THE PRESENT INVENTION

An atomizer for slurry fuel according to the present invention will be described with reference to FIGS. 1 to 4.

Figure 1:
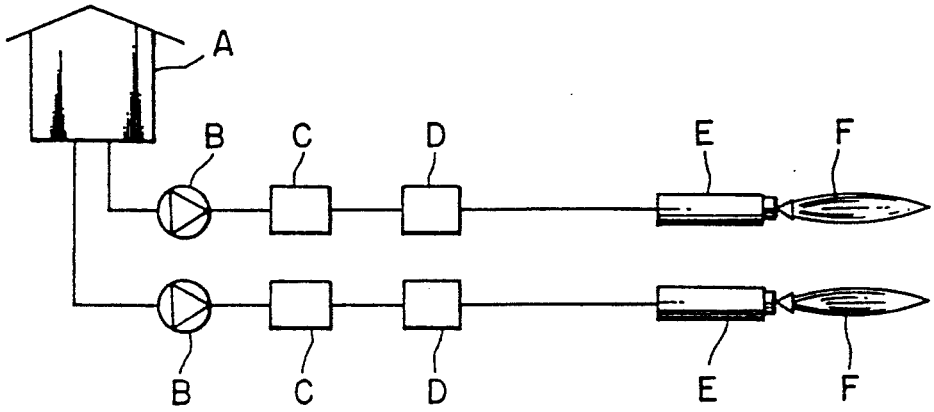
FIG. 1 is a view showing a CWM supply system employing an atomizer for slurry fuel according to the present invention.

FIG. 1 shows a CWM supply system employing an atomizer for slurry fuel according to the present invention. The system comprises a CWM tank A for containing a CWM therein, a pressure supply device B such as a pump, a strainer C, a flow meter D and an atomizer body E for atomizing the CWM.

Figure 2:
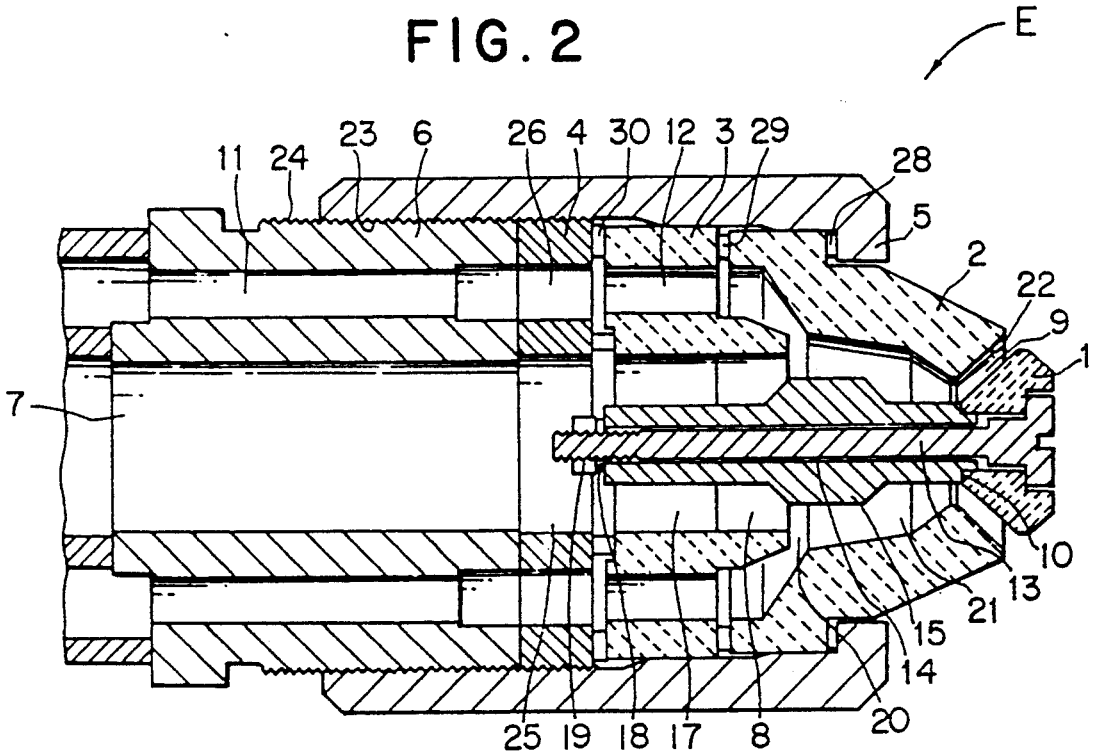
FIG. 2 is a cross-sectional view of the atomizer for slurry fuel according to the present invention.
Figure 3:
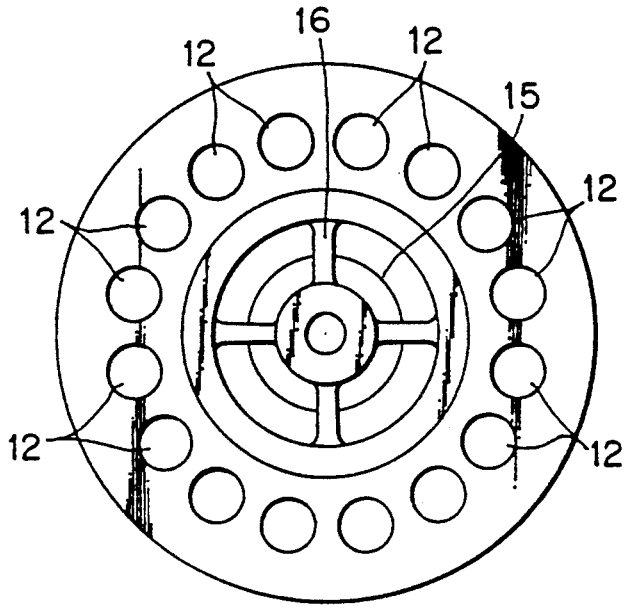
FIG. 3 is a rear view showing the intermediate member of the atomizer for slurry fuel according to the present invention.

FIG. 2 is a cross-sectional view of the atomizer for slurry fuel according to the present invention. The atomizer body E comprises a target 1, a steam, or end cap 2, an intermediate member 3, a fixed, or securing ring 4 and a cap 5 among which at least the target 1, the steam cap 2 and the intermediate member 3 are formed of ceramic and the cap 5 is formed of metal.

The atomizer body E is attached to a CWM supply body 6. The CWM supply body 6 comprises a first central passage 7 and an annular second passage 11 surrounding the first central passage 7. The first central passage 7 communicates with the fixed ring 4 for passing the CWM from the CWM tank A to the atomizer body E, and the annular second passage 11 communicates with the fixed ring 4 for passing an atomizing steam to the atomizer body E.

The intermediate member 3 comprises an annular slit 8 for jetting the CWM therefrom so as to form an annular liquid film, a tip, or target support portion 10 to which is fixed the target 1 for defining an inner surface of the fuel jet port 9 and a plurality of communication ports, or openings 12 (Refer to FIG. 3) for communicating with the second passage 11 by way of the fixed ring 4. The intermediate member 3 has a through hole 14 at the center thereof through which a set bolt 13 is inserted for fixing the target 1 to the tip portion 10. The annular slit 8 has a projection 15 defined on the entire circumference of the tip portion 10 of the intermediate member 3 and a flow dividing chamber 17 formed at the rear portion thereof by a strut wall 16.

The target 1 is frustoconical and fixed to the tip portion 10 of the intermediate member 3 by the set bolt 13. The set bolt 13 penetrates the through hole 14 and is fixed to the rear end of the intermediate member 3 at the rear portion thereof by a set nut 19 by way of a spring washer 18. The target 1 can be retained with assurance by the intermediate member 3 and the set bolt 13.

The steam cap 2 and the outlets of the communication ports 12 define an annular steam jet port 20 which communicates with the communication holes 12 of the intermediate member 3 and is directed toward the projection 15 of the annular slit 8. A mixing chamber 21 is defined between the steam jet port 20 and the fuel jet port 9. The steam cap 2 has a trumpet shaped opening surface at the tip portion thereof for forming an outer surface of the fuel jet port 9 while cooperating with the target 1. A first thread 23 is formed on the inner periphery of the cap 5 at the opening side thereof and the fixed ring 4 can be inserted into the cap 5 engaging with the thread 23. A second thread 24 is also formed on the outer periphery of the CWM supply body 6 so as to screw into the first thread 23.

Figure 4:
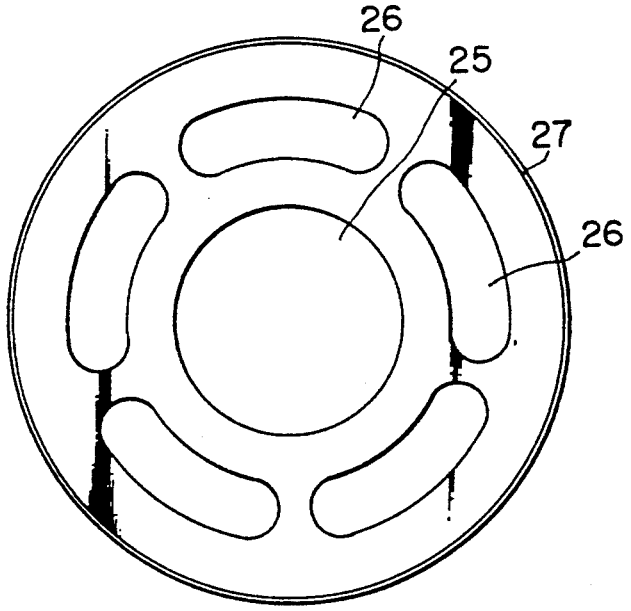
FIG. 4 is a rear view of the fixed ring of the atomizer for slurry fuel according to the present invention.

The fixed ring 4 has, as illustrated in FIG. 4, a passage 25 at the central portion thereof through which the CWM passes, a plurality of long slits 26 arranged around the passage 25 and a third thread 27 at the outer periphery thereof for screwing into the first thread 23. Upon completion of the assembly of these elements, one long slit communicates with a plurality of communication holes of the intermediate member 3 whereby the gas is almost uniformly supplied to the entire communication holes 12.

When the atomizer body E is attached to the CWM supply body 6, a first packing 28, the steam cap 2, a second packing 29, the intermediate member 3 and a third packing 30 are inserted into the cap 5 in this order, thereafter the fixed ring 4 is screwed into the cap 5 so that the steam cap 2 and the intermediate member 3 are held temporarily thereby.

Successively, the target 1 is provided at the tip portion 10 of the intermediate member 3 and thereafter the set bolt 13 is inserted into the through hole 14 of the intermediate member 3 so as to press the target 1 by the head of the set bolt 13 while the end portion of the set bolt 13 is fastened to the rear end of the intermediate member 3 by a set nut 19 by way of the spring washer 18.

Attaching the atomizer body E to the CWM supply body 6 is completed by screwing the cap 5 onto the CWM supply body 6 and fastening the same thereto at the state where the target 1, the steam cap 2, the intermediate member 3 and the fixed ring 4 is held by the cap 5. At the state of the assembly, the target 1, the steam cap 2 and the intermediate member 3 respectively formed of ceramic are fixed to the CWM supply body 6 in the compressing direction thereof. It is preferable that the inclination angle of the annular steam jet port 20 ranges from 30° to 60° and the clearance between the trumpet shaped opening surface 22 of the steam cap 2 and the target 1 for forming the fuel jet port 9 ranges from 1.0 to 3.0 mm for preventing the clearance from being blocked up by coal granule and for performing appropriate atomization of the coal granule.

The CWM in the CWM tank A is supplied to the atomizer body E through the strainer C, the flow meter D by the CWM pressure supply device B such as the pump, etc. and is atomized and jetted toward a flame F and is served for combustion.

The CWM which has passed through the flow meter D further passes the first passage 7 in the CWM supply body 6 and jetted from the annular slit 8 as the annular liquid film. At this time, since the projection 15 is formed at the tip end of the annular slit 8, the annular liquid film is formed with assurance while the CWM passing through the central portion is guided by the peripheral surface of the projection 15. Meanwhile, the atomizing steam passes through the second passage 11, the long slits 26 and the communication holes 12 and is jetted from the steam jet port 20 to thereby form an annular current. Thereafter, the atomizing jet strikes against the annular liquid film of the CWM whereby the CWM is atomized as it is separated from the surface of the annular liquid film of the CWM. Successively, the atomizing jet is mixed with the atomized CWM at the mixing chamber 21 so that the CWM is atomized more finely. The CWM expands along the tapered target 1 so that the contact area for contacting the atomizing jet is enlarged, which further facilitates the atomization of the CWM. The mixture of the CWM and the gas is jetted toward the flame F from the annular slit of the fuel jet port 9 while being atomized further.

The steam is employed as an atomizing gas according to the present invention, but air may be employed as the atomizing gas.

With the arrangement of the atomizer for slurry fuel, the CWM is introduced from the annular slit through the fuel introduction passage and jetted from the fuel jet port as the annular liquid film against which the annular current of the atomizing gas strikes whereby the CWM is atomized as it is separated from the surface of the annular liquid film. The CWM is mixed with the gas in the mixing chamber wherein the CWM is atomized more finely. The CWM expands along the tapered target 1 so that the contact area for contacting the atomizing jet is enlarged, which further facilitates the atomization of the CWM. As a result, the CWM is jetted from the annular slit of the fuel jet port 9 so as to be completely atomized. When the completely atomized CWM is employed by the atomizer for a burner, the ignition of the CWM is stabilized and the combustion efficiency is increased and the fuel cost is reduced.

Since the slurry fuel passage and the gas passage are integrally formed on the intermediate member, the atomizer body can be attached to the CWM supply body with ease whereby the atomizer body can be maintained, inspected and replaced by another atomizer body with ease.

If the projection is formed on the tip portion of the annular slit, the CWM flowing through the center is guided by the peripheral surface of the projection 15 whereby the annular liquid film is formed to be struck by the atomizing gas with assurance, so that the CWM is atomized more finely, which involves the stable ignition of the CWM, the increase of the combustion efficiency of the CWM and the reduction of the fuel cost.

Furthermore, since the intermediate member, the steam cap and the target are respectively formed of ceramic and the set bolt for fixing the target to the intermediate member penetrates the intermediate member and is retained at the rear end thereof by the lock nut and the atomizer body is fixed to the CWM supply body by the metal cap, the components are less worn by the slurry fuel. Still furthermore, the target, which is subjected to the high temperature, is not fixed to the intermediate member directly by the screw, the set bolt is prevented from being burned to stick to the target. Still furthermore, since the ceramic components are attached to the CWM supply body in the compressing direction, strong and reliable attachment can be assured.

What is claimed is:

1. An atomizer for slurry fuel comprising a fuel supply body having a first passage serving as a passage for slurry fuel and a second passage disposed outside the first passage serving as a gas passage and an atomizer body detachably attached to a tip end of the fuel supply body, wherein the atomizer body comprises:

an annular slit which communicates with the first passage for jetting the slurry fuel forming an annular liquid film;

a target for defining an inner surface of a fuel jet port;

a tip portion for retaining the target;

an intermediate member having a plurality of communication holes for communicating with the second passage and a flow dividing chamber for communicating with the first passage, the flow dividing chamber and the communication holes being integrally formed from the intermediate member;

a gas jet port which communicates with outlet ports of the communication holes and is directed toward a discharge side of the annular slit;

a steam cap having a mixing chamber which is defined between the gas jet port and the fuel jet port and an opening surface which cooperates with the target for forming an outer surface of the fuel jet port;

a fixed ring disposed adjacent to an intake side of the intermediate member; and the annular slit being defined by a raised shoulder extending longitudinally along the tip portion.

2. An atomizer for slurry fuel according to claim 1, wherein the intermediate member, the steam cap, and the target are respectively formed of ceramic, a set bolt for fixing the target to the intermediate member penetrates the intermediate member and is retained at the rear end thereof by a lock nut, and the atomizer body is fixed to the fuel supply body by a metal cap.

3. An atomizer for slurry fuel comprising a fuel supply body having a first passage serving as a passage for slurry fuel and a second passage disposed outside the first passage serving as a gas passage and an atomizer body detachably attached to a tip end of the fuel supply body, wherein the atomizer body comprises:

an annular slit which communicates with the first passage for jetting the slurry fuel forming an annular liquid film;

a target for defining an inner surface of a fuel jet port;

a tip portion for retaining the target;

an intermediate member having a plurality of communication holes for communicating with the second passage and a flow dividing chamber for communicating with the first passage, the flow dividing chamber and the communication holes being integrally formed from the intermediate member;

a gas jet port which communicates with outlet ports of the communication holes and is directed toward a discharge side of the annular slit;

a steam cap having a mixing chamber which is defined between the gas jet port and the fuel jet port and an opening surface which cooperates with the target for forming an outer surface of the fuel jet port;

a fixed ring disposed adjacent to an intake side of the intermediate member; and the intermediate member, the steam cap, and the target are respectively formed of ceramic, a set bolt for fixing the target to the intermediate member penetrates the intermediate member and is retained at the rear end thereof by a lock nut, and the atomizer body is fixed to the fuel supply body by a metal cap.

4. An atomizer for slurry fuel including a fuel supply body having a first passage for passing slurry fuel to an atomizer body and a second passage for passing a gas to the atomizer body, said first passage being concentrically disposed within said second passage, said atomizer body being detachably attached to a tip end of the fuel supply body, wherein the atomizer body comprises:

an intermediate member disposed adjacent to a discharge side of said fuel supply body, said intermediate member including a plurality of openings therethrough for communication with said second passage and a flow dividing chamber extending therethrough for communication with said first passage, said flow dividing chamber disposed substantially concentrically within said plurality of gas openings and separated therefrom by an intermediate annular wall;

a target support member axially and substantially concentrically disposed within said flow dividing chamber and fixedly secured to said intermediate member, said target support member extending longitudinally downstream from within said flow dividing chamber;

a conical target secured to a downstream tip portion of said target support member;

an end cap disposed adjacent to a discharge side of said intermediate member and encompassing a discharge side of the flow dividing chamber, said target support member, and said conical target;

an annular slit disposed at said discharge side of the flow dividing chamber and defined between said intermediate annular wall and said target support member for jetting therethrough the slurry fuel in the form of an annular liquid film;

a gas jet port defined between said intermediate annular wall and an inner wall of said end cap, said gas jet port communicating with said openings to direct the gas toward a downstream side of said annular slit;

an annular fuel jet port defined between an outer surface of said conical target and a surrounding opening surface of said end cap for jetting fuel therethrough;

a mixing chamber defined between said inner surface of the end cap and said target support member for mixing the slurry fuel and the gas, said mixing chamber extending between said annular slit and said fuel jet port;

a securing ring interposed between said fuel supply body and said intermediate member and having exterior threads;

an outer cap surrounding said securing ring, said end cap and said intermediate member, said outer cap being threadably engaged with said securing ring for rigidly securing said intermediate member and said end cap to said outer cap to facilitate installation of said atomizer body to said fuel supply body; and said target support member including a raised shoulder portion substantially coincident with and extending longitudinally downstream from said discharge side of the flow dividing chamber.

5. An atomizer for slurry fuel according to claim 4, wherein the intermediate member, the end cap, and the target are respectively formed of ceramic.

6. An atomizer for slurry fuel including a fuel supply body having a first passage for passing slurry fuel to an atomizer body and a second passage for passing a gas to the atomizer body, said first passage being concentrically disposed within said second passage, said atomizer body being detachably attached to a tip end of the fuel supply body, wherein the atomizer body comprises:

an intermediate member disposed adjacent to a discharge side of said fuel supply body, said intermediate member including a plurality of openings therethrough for communication with said second passage and a flow dividing chamber extending therethrough for communication with said first passage, said flow dividing chamber disposed substantially concentrically within said plurality of gas openings and separated therefrom by an intermediate annular wall;

a target support member axially and substantially concentrically disposed within said flow dividing chamber and fixedly secured to said intermediate member, said target support member extending longitudinally downstream from within said flow dividing chamber;

a conical target secured to a downstream tip portion of said target support member;

an end cap disposed adjacent to a discharge side of said intermediate member and encompassing a discharge side of the flow dividing chamber, said target support member, and said conical target;

an annular slit disposed at said discharge side of the flow dividing chamber and defined between said intermediate annular wall and said target support member for jetting therethrough the slurry fuel in the form of an annular liquid film;

a gas jet port defined between said intermediate annular wall and an inner wall of said end cap, said cap jet port communicating with said openings to direct the gas toward a downstream side of said annular slit;

an annular fuel jet port defined between an outer surface of said conical target and a surrounding opening surface of said end cap for jetting fuel therethrough;

a mixing chamber defined between said inner surface of the end cap and said target support member for mixing the slurry fuel and the gas, said mixing chamber extending between said annular slit and said fuel jet port;

a securing ring interposed between said fuel supply body and said intermediate member and having exterior threads;

an outer cap surrounding said securing ring, said end cap and said intermediate member, said outer cap being threadably engaged with said securing ring for rigidly securing said intermediate member and said end cap to said outer cap to facilitate installation of said atomizer body to said fuel supply body;

said intermediate member further including a strut wall traversing an intake side of said flow dividing chamber, said target support member being fixedly secured to said strut wall; and a set bolt for securing said target to said target support member, said set bolt passing through said target support member and being retained to said strut wall by a lock nut.

7. An atomizer for slurry fuel according to claim 6, wherein the intermediate member, the end cap, and the target are respectively formed of ceramic.

* * * * *

UNITED STATES PATENT AND TRADEMARK OFFICE

CERTIFICATE OF CORRECTION

PATENT NO. : 5,307,996

DATED : May 3, 1994

INVENTOR(S) : Shizuo Kataoka et al

It is certified that error appears in the above-indentified patent and that said Letters Patent is hereby corrected as shown below:

Column 8, line 21; change "cap" (second occurrence) to ---gas---.

Signed and Sealed this

Eighth Day of November, 1994

Bruce Lehman

*Attest:*

BRUCE LEHMAN

*Attesting Officer*

*Commissioner of Patents and Trademarks*